United States Patent [19]

Simmons, Jr. et al.

[11] 4,442,746

[45] Apr. 17, 1984

[54] ELECTRONIC ORGAN HAVING AN IMPROVED TONE GENERATOR SYSTEM

[75] Inventors: Carlton J. Simmons, Jr., Florence, Ky.; Dale M. Uetrecht, Cincinnati, Ohio

[73] Assignee: Baldwin Piano & Organ Company, Cincinnati, Ohio

[21] Appl. No.: 163,409

[22] Filed: Jun. 26, 1980

[51] Int. Cl.[3] ..... G10H 1/00

[52] U.S. Cl. ..... 84/1.01; 84/1.17; 84/1.03; 84/DIG. 2; 84/DIG. 23

[58] Field of Search ..... 84/1.01, 1.17, 1.03, 84/1.24, DIG. 2, DIG. 23

[56] References Cited

U.S. PATENT DOCUMENTS 4,202,239 5/1980 Southard et al. ..... 84/1.26

*Primary Examiner*—Forester W. Isen

*Attorney, Agent, or Firm*—Kirkland & Ellis

[57] ABSTRACT

A tone generator system for an electronic organ, which incorporates N programmable generators (where N is less than 12, and typically 7) which forms a system having the ability to sound notes of N different nomenclature tones at one time. A microprocessor controls the assignment of particular notes to each of the programmable generators, in accordance with the played keys of the keyboard(s) (and the tab switches, in the event that a partial footage is selected). Each of the programmable generators is connected to a chain of dividers and gates which are also under the control of the microprocessor. The information ascertained by the microprocessor from the keyboard(s) (and the tab switches) is used to control the selection of gates which control the passage of tone signals from appropriate dividers in the chains of dividers to an audio output system. More than one note of a particular nomenclature can be simultaneouly gated from the divider chain of a particular programmable generator.

12 Claims, 9 Drawing Figures

EIGHT SEMITONES FROM
TOP OCTAVE FREQUENCY GENERATOR

ADDRESS FROM
FREQUENCY
LATCHES
281
C M O S 4512
DATA
SELECTOR
280
DISABLE
TO MUTE
LATCH
299
GATE
240
DIVIDER
291
GATE
241
DIVIDER
292
GATE
242
DIVIDER
293
GATE
243
7 STAGE
DIVIDER
4024
DIVIDER
294
GATE
244
DIVIDER
295
GATE
245
DIVIDER
296
GATE
246
DIVIDER
297
GATE
297

GENERATOR ASSIGNMENT SEQUENCE

PRIORITY SEQUENCE II
CHROMATIC NOTE STACK

ELECTRONIC ORGAN HAVING AN IMPROVED TONE GENERATOR SYSTEM

BACKGROUND OF THE INVENTION

1. Field of the Invention

The present invention relates to an electronic organ having an improved system for generating tone signals, and more particularly, pertains to an organ system wherein digital logic circuitry controls programmable generators and a network of gates so as to produce the tones called for by the played notes of the organ, while minimizing the actual number of generators required to produce the desired musical effect.

2. Description of the Prior Art

The prior art teaches the use of conventional diode keying techniques where each gate receives a single input signal of a specified frequency, and an associated key switch on the keyboard controls the gate. The key switches of the keyboard may control gates of various footages, in accordance with the voices made available by the organ. Accordingly, in prior art systems there must be a separate gate for each note of each manual, and for each footage which can be played by such note. For example, an organ with two 44-note manuals having 8-foot and 4-foot voices on each, would require 176 separate gates.

This form of conventional diode keying is shown by way of example in U.S. Pat. No. 3,223,768 to Munch, et al. and U.S. Pat. No. 3,580,980 to Uetrecht, both assigned to the same assignee as the present invention.

An alternative tone generator system is taught in U.S. Pat. No. 3,515,792 to Deutsch which shows a generator system using stored digital representations of pipe organ wave forms. In the Deutsch system, wave forms characteristic of particular organ voices are stored in a digital format. Recycling read controls 22A through 22N read out the stored wave forms at speeds dictated by frequency synthesizer 10. In this manner, each recycling read control can cause one note to be produced. It should be noted, however, that octavely related notes cannot be produced simultaneously by a single recycling read control. Rather, the Deutsch system requires a separate recycling read control for each note to be sounded, regardless of whether the notes are octavely related. As a result, the Deutsch system is only capable of sounding as many notes at one time as there are recycling read control circuits.

SUMMARY OF THE INVENTION

In most cases, no more than seven chromatically different tones are played on an organ or other musical instrument at one time. Accordingly, it would be a desirable advance in the art to develop a tone generator system which would serve the instrumentalist's musical requirements, while eliminating the five gates per octave which are typically not in use at any given time. A microprocessor controlled system in accordance with the present invention can assign programmable tone generators to produce the up to seven chromatically distinct tone frequencies required at any one time. Since there are only seven tone generators, there need only be seven sets of gates, thereby eliminating the need for more than 40% of the gates associated with an organ system built in accordance with the prior art. In addition, by reducing the number of gates, the number of paths by which generator signals could leak through to the output system is reduced, thereby minimizing a problem inherent in diode-gate circuitry.

The microprocessor which controls the programmable tone generator system in accordance with the present invention assigns notes to each of the programmable generators in accordance with the notes called for by the played keys of the keyboard(s) (and the tab switches in the event that a partial footage voice has been selected). Each of the programmable tone generators has an associated chain of dividers such that the note assigned to each tone generator can be produced in any of the octaves available to the organ. The microprocessor triggers the gates associated with the divider chain of particular programmable generators as necessary to cause the appropriate note at the appropriate pitch to be gated through to the audio output system. Sustain controls which are under the control of the microprocessor are also associated with each of the gates, so that the attack and decay characteristics of the played notes can be controlled.

Accordingly, it is a principal object of the present invention to provide an improved device for generating tone signals in an electronic musical instrument, particularly an electronic organ.

A further object of the present invention is to provide an improved electronic organ having a device for generating tone signals wherein fewer than twelve sets of dividers and gates are necessary to produce the desired musical result.

Another object of the present invention is to provide a means of generating tone signals which is suited for use in conjunction with a microprocessor controlled organ system.

Another object of the present invention is to provide an organ system designed to use the minimum amount of programmable signal generators, gates, and associated circuitry necessary to produce a satisfactory musical result.

These and other objects, advantages and features are hereinafter set forth, and for purposes of illustration but not limitation, certain preferred embodiments of the present invention are hereinafter described and illustrated in the accompanying drawings.

DETAILED DESCRIPTION OF THE PREFERRED EMBODIMENTS

The basic operation of a microprocessor controlled organ system in accordance with the present invention is as described below. The microprocessor includes a random access memory, a portion of which is used to store information regarding the identity of notes to be sounded by the organ. The microprocessor stores a "1" in its memory at the location allocated to a particular note if the key on the keyboard corresponding to that note is actuated, and a "0" in the memory location corresponding to each key on the keyboard which is not actuated. The status of the various keys of the keyboard (as well as the status of stop control switches and mode selector switches) is ascertained by addressing the location of these keys and switches, and loading this information into designated portions of the memory. This operation is performed under the control of the microprocessor, and at intervals selected so as to eliminate any audible delay in the response of the instrument to a change in the status of a key or switch. Programmable signal generators are then assigned to produce tones corresponding to notes to be sounded (i.e., the notes played plus the notes to be filled-in) and these tones are transmitted to an appropriate output system.

Figure 1:
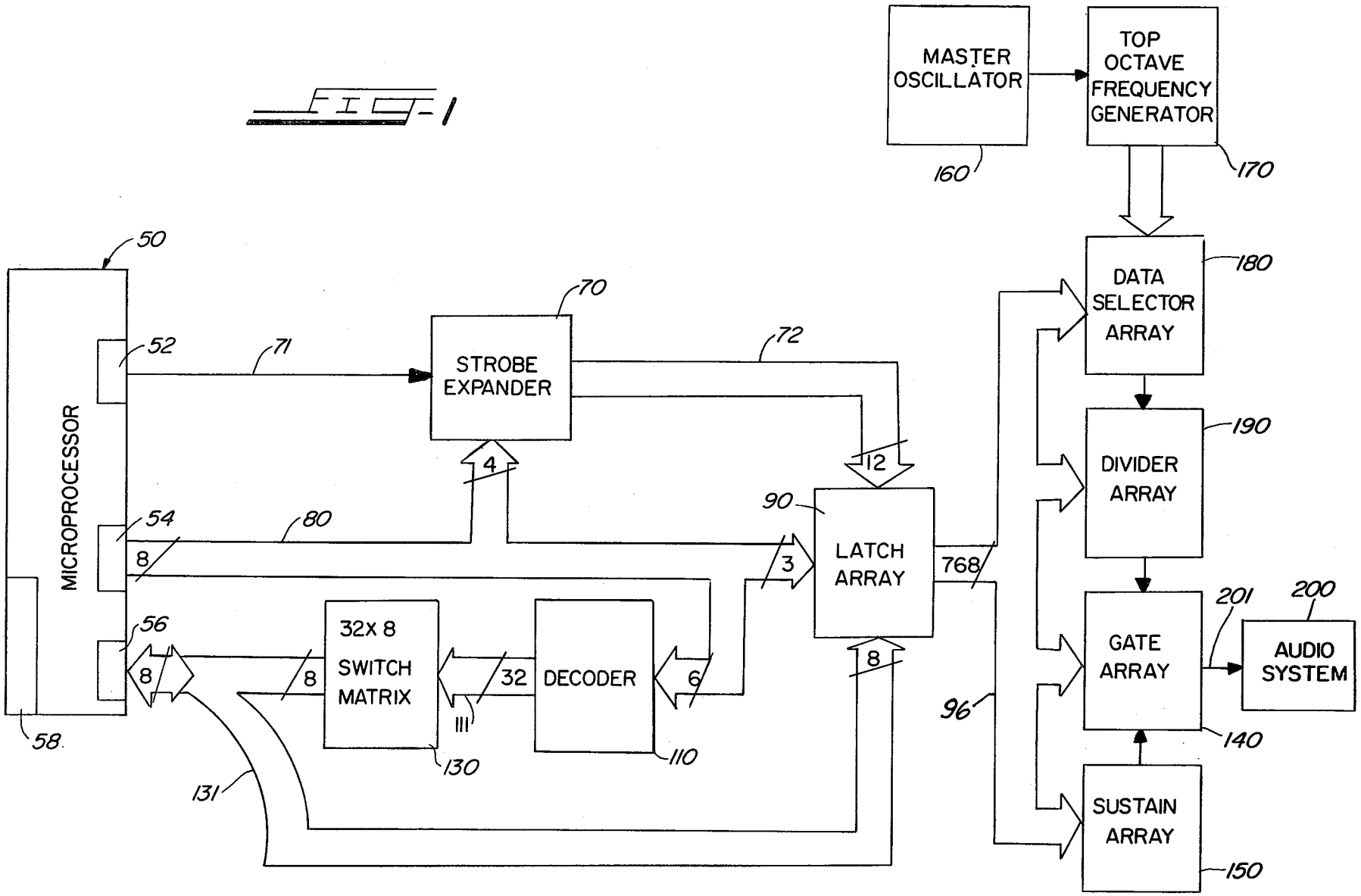
FIG. 1 is a block diagram of a microprocessor controlled organ system with programmable generators in accordance with the present invention.

In a typical microprocessor controlled organ system, as shown in FIG. 1, microprocessor 50 includes a strobe 52, an output port 54, a bidirectional input/output port ("I/O port") 56, and a random access memory 58. For clarity, other conventional features of the microprocessor 50 are not shown. Strobe 52 of microprocessor 50 is connected to strobe expander 70 by a line 71. Strobe expander 70 is connected in turn to latch array 90 via 12 lines 72. Output bus 80 connects the output port 54 of microprocessor 50 to the rest of the organ system via the eight lines which comprise output bus 80 as follows: four lines of output bus 80 are connected to strobe expander 70; three lines of output bus 80 are connected to latch array 90; and six lines of output bus 80 are connected to decoder 110. Five of the six lines connected to decoder 110 are also connected to strobe expander 70 or latch array 90. However no ambiguity arises because, as described below, the strobe expander 70 and latch array 90 are only addressed during operations affecting the output system (i.e., gate array 140, sustain array 150, data selector array 180 and divider array 190) whereas the decoder 110 is only addressed when the status of the switches in switch matrix 130 is being read into the memory 58 of microprocessor 50. Decoder 110 is connected to switch matrix 130 by decoder bus 111 which comprises 32 lines which are addressed sequentially by decoder 110. Each of the 32 lines 111 addresses eight switches of the switch matrix and the status of the 32 sets of eight switches per set is thereby read into microprocessor 50 via the eight lines of I/O bus 131, as a series of 32 8-bit words. In this manner, the microprocessor 50 ascertains the condition of each of the switches in the switch matrix 130, as depicted in step 500 in the flow chart comprising FIG. 7. The switch matrix 130 includes a switch for each key of the keyboard(s) (not shown) as well as each of the stop switches (i.e., voice selection controls—not shown) and function selection switches (e.g., automatic fill-in, automatic chording, and sustain—not shown). This information is read into the microprocessor 50 for further processing in accordance with the instructions called for by the switches.

Figure 2:
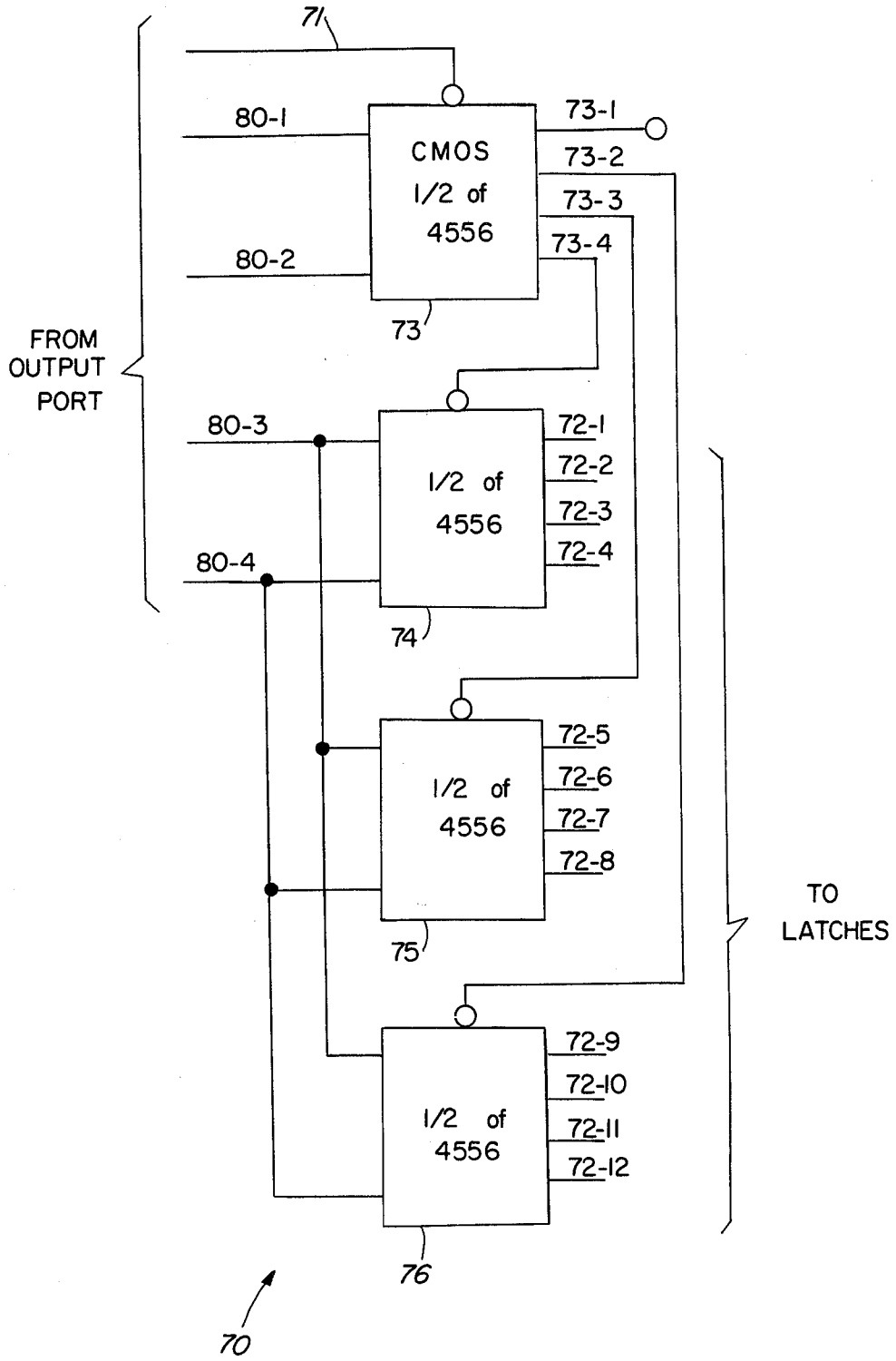
FIG. 2 is a schematic diagram of a strobe expander circuit.

As shown in FIG. 2, strobe expander 70 comprises four one-of-four decoders 73, 74, 75, and 76. Addresses received by decoder 73 on lines 80-1 and 80-2 of output bus 80 cause decoder 73 to select one of four outputs 73-1, 73-2, 73-3 or 73-4, when decoder 73 is enabled by a signal on strobe line 71. Lines 73-2, 73-3 and 73-4 are respectively connected to the enable leads of decoders 76, 75, and 74. Line 73-1 (address 00) is left open so that the strobe does not output a signal on any of lines 72-1 through 72-12 when lines 80-1 and 80-2 are both low (i.e., during addressing of the switches as discussed below). The address on lines 80-1 and 80-2 selects which of the three decoders 74, 75, or 76 will be enabled by the strobe signal on line 71. The decoders 74, 75, and 76 are each addressed by the two lines 80-3 and 80-4 so as to select one of the four output leads of each of the three decoders 74, 75, and 76. However, only one of the three decoders 74, 75, and 76 will be enabled by a given address applied to decoder 73. Accordingly, only one of the twelve outputs 72-1 through 72-12 of decoders 74, 75, and 76 will be pulsed at any one time. Thus, the strobe output on line 71 is expanded into a strobe signal on one of twelve lines 72 in accordance with the addresses on output bus lines 80-1 through 80-4.

Figure 3:
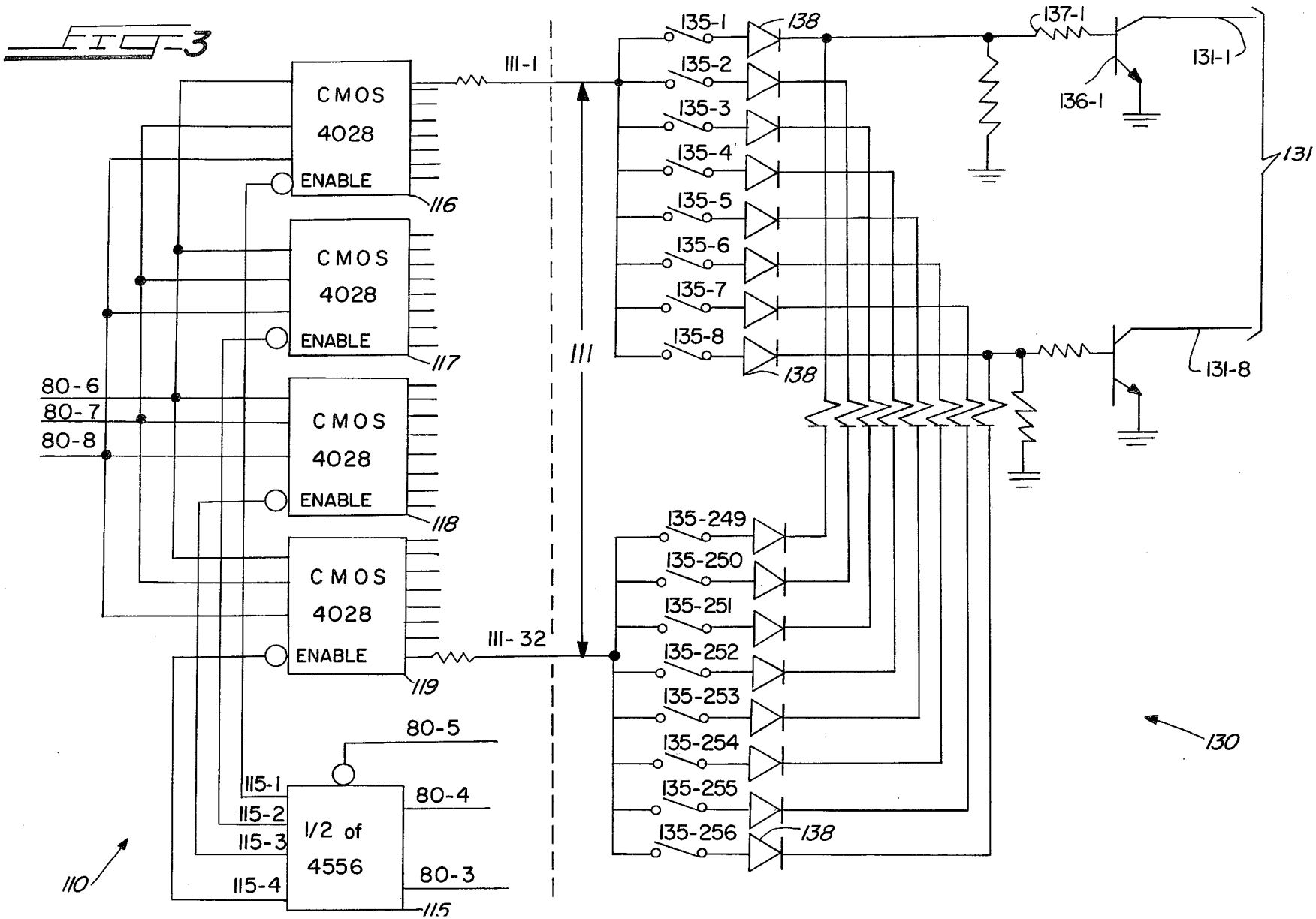
FIG. 3 is a circuit diagram for the decoder and the 32 by 8 switch matrix.

As shown in FIG. 3, decoder 110 includes one one-of-four decoder 115, and four one-of-eight decoders 116, 117, 118 and 119. One-of-four decoder 115 is addressed by lines 80-3, 80-4, of output bus 80, and is triggered by line 80-5 of output bus 80. When line 80-5 is low, whichever one of the four output leads 115-1 to 115-4 is selected by the address on leads 80-3 and 80-4 goes low. Lines 115-1 to 115-4 are respectively connected to the enable inputs of decoders 116-119. Because decoder 115 only passes a signal on leads 115-1 to 115-4 when lead 80-5 is low, leads 80-3 and 80-4 can also be used to address strobe expander 70 as discussed above in connection with FIG. 2. Each of the four one-of-eight decoders 116, 117, 118, and 119 is addressed by the three lines 80-6, 80-7, and 80-8 of output bus 80, so as to produce a pulse on the addressed output line of whichever one-of-eight decoder (116, 117, 118 or 119) is strobed by the one-of-four decoder 115. Each of the thirty two lines 111-1 through 111-32 (four decoders, eight outputs per decoder) is, in turn connected to eight switches 135 of the organ, such as keyswitches, stop (voicing) switches, and the like. The output of each of the thirty two switches 135 in the first position within the thirty two groups of eight switches (i.e., switches 135-1; 135-9; 135-17; . . . 135-249) is connected through its associated isolation diode 138 to the first line 131-1 of the I/O bus 131, through a shaper circuit consisting of resistor 137-1 and transistor 136-1. Similarly, each of the other seven groups of 32 switches per group is connected to one of the remaining seven lines 131-2 through 131-8 of I/O bus 131.

Thus, by choosing an appropriate address on lines 80-3 through 80-8, the mircroprocessor 50 can select any of the thirty two outputs 111 of decoder 110. The selected output interrogates eight of the switches 135 and reads them into the microprocessor 50 via I/O bus 131 as an 8-bit word. In this manner, the microprocessor is able to ascertain the status of up to 256 keyswitches, control switches, and stop (voicing) switches by interrogating each of the thirty two groups of 8 switches in any sequence desired.

Referring again to FIG. 1, master oscillator 160 and top octave frequency generator 170 are both known in the art. For example, as shown in vendor (Mostek) data sheet IC Type #MK50240N, the top octave frequency generator 170 processes the signal from master oscillator 160 to produce twelve signals corresponding to the twelve notes of the musical scale, and located at or above the highest octave in which that note can be played on the keyboard. U.S. Pat. No. 3,816,635-Uetrecht, assigned to the same assignee as the present invention, also teaches a top octave generator structure.

In accordance with the present invention, the signals produced by the top octave frequency generator 170 are provided to a plurality of data selectors in data selector array 180 which pass the tone signals to a series of dividers in divider array 190 in accordance with control signals provided by microprocessor 50 via latch array 90, and responsive to the played keys of the keyboard and selected control functions.

Figure 4:
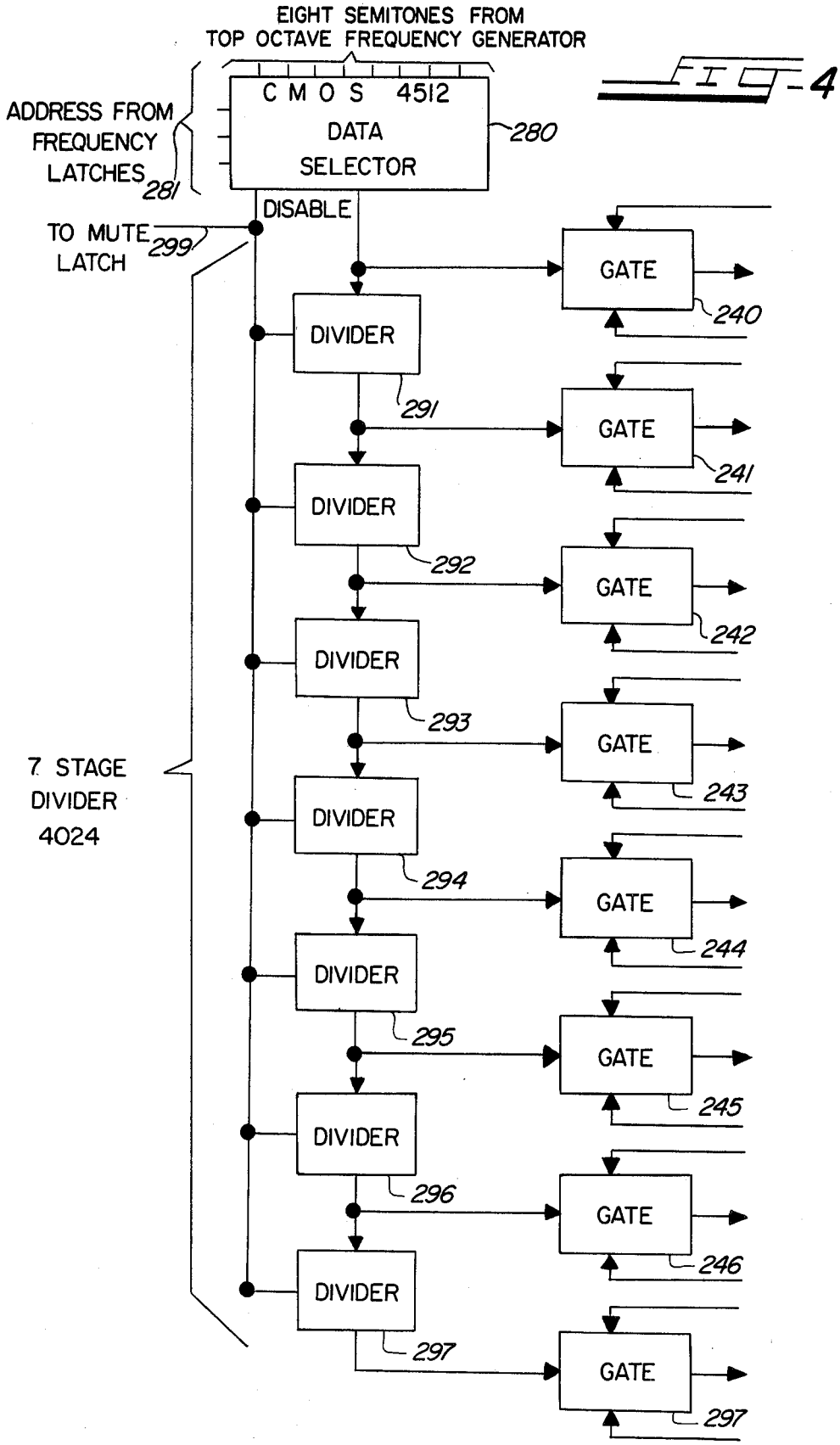
FIG. 4 is a block diagram of a typical data selector including the gate and divider circuits.

Each divider of divider array 190 divides its input frequency by two, thereby making available all the lower octaves of the tones produced by the top octave frequency generator 170 which can be called for by played keys of the keyboard. Accordingly, a data selector and its associated dividers and gates function as a programmable signal generator under the control of microprocessor 50. As shown in FIG. 4, a typical series of dividers 291 through 297 is associated with typical data selector 280. All the dividers in the portion of the divider array 190 shown in FIG. 4 can be reset by a signal on line 299 connected to a mute latch (not shown) of latch array 90. When line 299 is high, the outputs of the data selector 280 and the dividers 291 through 297 are held low, thereby muting out any audio signal from the corresponding programmable generator. If the mute line is not used, data selector 280 and the dividers 291–297 are permitted to toggle at the last assigned freqency when not in use. The outputs of each divider of divider array 190 (as well as the "undivided" outputs of the top octave frequency generator 170) are connected to a gate array 140. A series of typical gates 240 through 247 associated with typical data selector 280 and typical dividers 291 through 297 is also shown in FIG. 4. Each of the gates of gate matrix 140, including gates 240 through 247 shown in FIG. 4, is connected to an associated keying latch (not shown) of latch array 90 so that any desired octave of the notes selected by data selectors 180 can be passed to the audio output system 200 via line 201 as described in detail below. Each of the gates of gate matrix 140 including gates 240 through 247 shown in FIG. 4 is also connected to sustain control 150 as described in detail below.

A plurality of programmable generators as shown in FIG. 4 are provided in accordance with the present invention. It can readily be seen that each programmable generator (i.e., a data selector and its associated dividers and gates) can only produce tones of a single nomenclature at any one time. Further, since the data selectors used in the preferred embodiment of the present invention can only accomodate eight inputs each, one data selector could not accomodate a full twelve tone musical scale, and two such data selectors would be the absolute minimum for a practical instrument. If twelve programmable generators (i.e., twelve sets of data selectors along with their associated dividers and gates) were provided, notes of all twelve nomenclatures of the musical scale could be provided simultaneously. However, since most keyboard music rarely calls for the playing of notes of more than seven different nomenclatures at one time, provision of twelve programmable generators would be wasteful since five of them would probably never be needed. Therefore, an electronic musical instrument in accordance with the preferred embodiment of the present invention would have a data selector array 180 comprising seven data selectors which in turn would be connected to corresponding dividers and gates as shown in FIG. 4.

Figure 5:
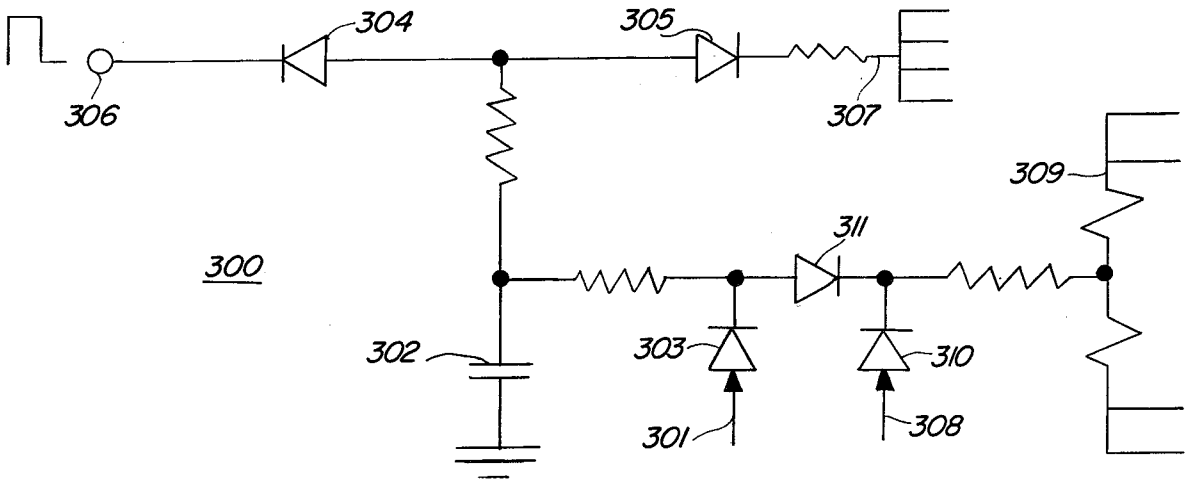
FIG. 5 is a schematic diagram of a typical gate circuit.

A typical gate circuit 300 is shown in FIG. 5. When the keying latch (not shown) which corresponds to gate circuit 300 is set by microprocessor 50, line 301 (which connects gate circuit 300 to its corresponding keying latch—not shown) goes high, and capacitor 302 charges through diode 303. When there is a sufficient charge on capacitor 302, diodes 304 and 305 are both forward biased. As a result, the signal provided at terminal 306 (by the divider or data selector which corresponds to gate 300) is passed to the audio output system via output lead 307. The decay characteristics of the signal passed by gate circuit 300 depends on the voltage on line 308 and sustain bus 309. Line 308 is connected to the sustain latch (not shown) associated with gate circuit 300. When the associated sustain latch (not shown) is set by microprocessor 50 (as described above), the gate will exhibit long sustain because the voltage applied on line 308 through diode 310 prevents capacitor 302 from discharging through diode 311 to the sustain bus 309. When the associated sustain latch is reset, and there is a low voltage on line 308, capacitor 302 will discharge to the sustain bus (thereby causing the signal passed by the gate to output lead 307 to decay), at a rate of which depends upon the voltage on sustain bus 309. If the voltage on the sustain bus 309 is negative (e.g., −15 v), capacitor 302 drains rapidly, thereby producing an "organ" damp effect. If the voltage on the sustain bus is slightly positive (e.g. +0.7 v) a short sustain effect results. It should be noted that sustain bus 309 controls a large group of the gate circuits of gate matrix 140, while line 308 is controlled by a latch (not shown) associated with the particular gate in question. In a low cost instrument, typical line 308 can be shared for all octaves of each programmable generator. Only seven lines 308 are required for each sustain bus 309.

Figure 6:
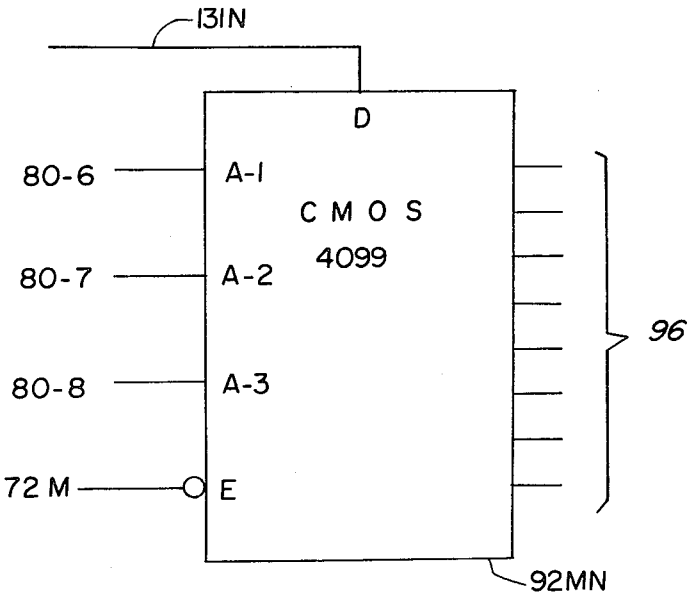
FIG. 6 is a schematic diagram of a typical latch circuit.

Referring to FIG. 1, once the notes to be sounded have been determined, this data is transmitted to the gate matrix 140 as follows. The strobe 52 transmits sequential timing pulses via line 71 to strobe expander 70. The four lines of output bus 80 which are connected to strobe expander 70 address one of the twelve outputs of the strobe expander 70 so that the strobe pulses are transmitted to latch array 90 on the selected one of the twelve lines of the strobe bus 72. Latch array 90 includes 96 latches 92, arranged in twelve sets of 8 latches per set. A typical latch 92-MN of latch array 90 is shown in FIG. 6. The enable lead "E" of latch 92-MN is connected to strobe output line 72-M, which is the Mth one of the twelve lines of strobe output bus 72. Similarly, the data lead "D" of latch 92-MN is connected to line 131-N which is the Nth one of the eight lines of I/O bus 131. The three latch inputs A-1, A-2, and A-3 receive an address from microprocessor 50 via lines 80-6, 80-7, and 80-8 of output bus 80. This address selects one of the eight latch outputs 96. When the enable lead E of latch 92-MN is pulsed by the strobe expander output on strobe output bus line 72-M, the data on line 131-N of I/O bus 131 is output on whichever one of the eight output leads 96 has been addressed.

Each of the 8 latches in the Mth set (i,e., latches 92-M1 to 92-M8) is connected to line 72-M of strobe output bus 72, so that these latches are simultaneously enabled when the address read into the strobe expander 70 selects line 72-M. Since the data input of each of the 8 latches 92-M1 to 92-M8 is connected to a different one of the eight lines 131-1 to 131-8 of I/O bus 131, each pulse on a line 72-M of the strobe output bus 72 causes an 8-bit word to be read into the 8 latches 92-M1 to 92-M8 from the microprocessor 50. As stated above, this 8-bit word is transmitted to the latch outputs 96 which are selected by the address from the output bus 80.

The latch outputs 96 are in turn connected to the data selector array 180, divider array 190, the gate array 140 and the sustain array 150, which collectively control the transmission of generator signals from the top octave frequency generator 170 to the audio output system 200. In this manner, the microprocessor 50 controls the state of each of the 96 latches 92, each of which in turn has eight outputs. Thus, in the preferred embodiment of the present invention, microprocessor 50 can control a total of up to 768 latch bits. These latch bits are used to control the production of sound in accordance with the keys and functions selected by the user of the instrument as described below. The latches 92 stay set until a switch scan detects a change (step 510, FIG. 7) whereupon the microprocessor 50 addresses the appropriate latches 92 in order to effect the change called for by the change in the status of the switches of switch matrix 130. It should be noted that since the microprocessor 50 controls the various inputs to the latch array 90 (i.e., the address applied to the latches 92, the data input to the latches 92, and which of the lines of the strobe output bus 72 is pulsed), the microprocessor 50 can signal individual gates, in any desired sequence, and as necessary to update gate status, without counting through all 768 outputs of latch array 90.

After addressing the keyswitches, stop switches, and function switches of the organ, the microprocessor 50 calculates output data regarding what notes are to be sounded, and at what frequency. The microprocessor 50 then sets latches as described above so as to cause the data selector array 180 to feed the appropriate top octave note signals into the divider array 190. If there are not an adequate number of data selectors available (i.e., all the data selectors are already assigned to generate other notes) a note priority control, which establishes priorities determined by the microprocessor control instructions, will damp out one of the played notes and reassign the data selector in question to the new note to be sounded (see FIG. 7, step 530). Other types of priorities can also be prescribed by the note priority control to handle situations in which there are not enough data selectors available, in accordance with the musical effect which is desired (see FIGS. 8 and 9 which elaborate steps 510 and 520 of FIG. 7). Once the pitch assigned to the data selectors has been determined, the octave at which that pitch will be sounded is selected by setting the latch associated with the gate located at the appropriate link in the divider chain, as discussed above. It should be noted that a single data selector can produce a note of a given nomenclature in more than one octave, simply by setting one or more additional latches associated with that data selector's divider chain (see e.g., steps 540 and 550 in FIG. 7).

An example of the operation of the above-described system is as follows. If a C chord were played in the fourth octave with the 4' tab on, the microprocessor 50, as depicted in step 500 on FIG. 7, would interrogate the $32\times8$ switch matrix 130, and identify C4, E4 and G4 as the played keys, and the 4' tab as the selected voicing. Proceeding through steps 520–550 of FIG. 7 the microprocessor would then determine the appropriate latches to be set so as to select and assign three data selectors of data selector array 180 to the nomenclatures C, E, and G, respectively. The microprocessor 50 then would determine the octave in which the played notes are to be sounded, and would set the appropriate latches so as to cause the gates in the divider chain of the assigned data selectors to pass the corresponding 4' signals in the fifth octave (i.e. $C_5$, $E_5$, $G_5$).

Figure 7:
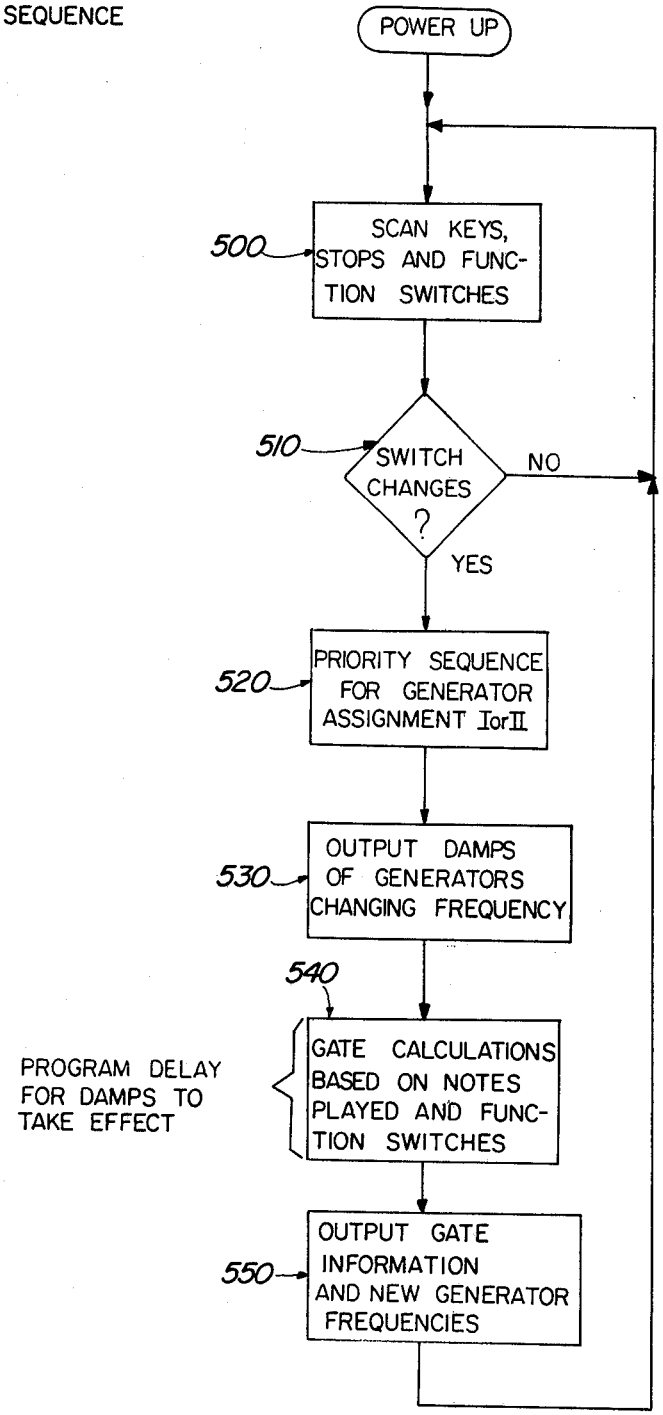
FIG. 7 is a flow chart depicting the generator assignment sequence.

If the C chord were changed to Cm (i.e., if E4 were changed to Eb4) the next time the microprocessor 50 interrogated the $32\times8$ switch matrix 130 (which happens with sufficient frequency that there is no audible delay in the reaction of the instrument), it would detect the change of a played note from E4 to Eb4 at step 510 on FIG. 7. If there were an unassigned data selector, the microprocessor would assign it to the nomenclature Eb. The gate in the E divider chain would be turned off, and the gate associated with the 4' voice of Eb4 (i.e. Eb5) would be turned on in the divider chain of the Eb data selector. No operation need be performed on the C and G data selectors and gates since those keys did not change. If all the data selectors had already been assigned, the microprocessor would have damped out the E4 gate circuit by resetting the sustain latch associated with that gate. The data selector previously assigned to E would thus be made available, and would therefore be assigned to the Eb nomenclature. Provision for the damping and reassigning of data selectors by the note priority can be made to handle other types of conflicts regarding the unavailability of data selectors.

Figure 8:
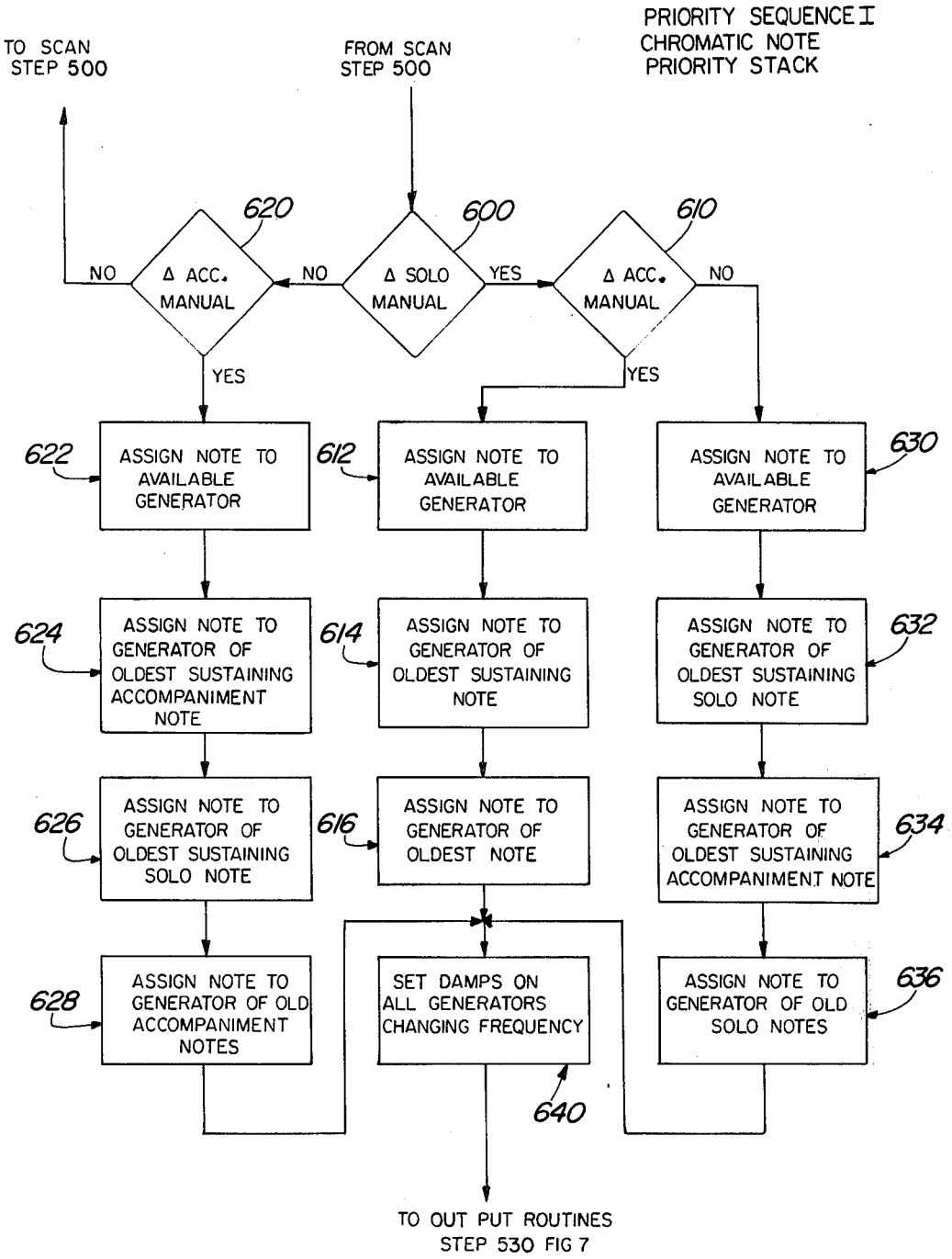
FIG. 8 is a flow chart depicting a priority sequence for assigning generators.

The basic priority structure, Priority Sequence I (Chromatic Note Priority Stack), is depicted in flow chart form in FIG. 8 and can be illustrated with reference to a situation in which there is a change in the played keys of the solo keyboard (step 600) and no change in the played keys of the accompaniment keyboard (steps 610-636, FIG. 8). A change in the played solo keys will not cause a transfer of a generator already assigned to a played accompaniment note. If the organ is in the "sustain" mode (so that the generator must continue to produce a note even after that note is released), a change in the played solo keys should not deprive (at least some of) the accompaniment notes of their generators, since to do so would interrupt the sustain effect. The number of sustaining notes which are protected from appropriation in this manner is a matter of choice, and depends upon the number of generators available. Consistent with the foregoing, it is desirable to make a generator available for each newly played note in order to produce an acceptable musical result (steps 630). Accordingly, if an adequate number of generators is not available, the first class of generators which will be reassigned are those generators which are being used to produce sustaining solo notes (i.e., solo keys which have been released in the sustain mode, and whose damping is not yet completed), with the oldest sustain note being transferred first (step 632). The next available source which will be used for the transfer of generators will be sustaining accompaniment notes which are not protected from appropriation (step 634). Finally, if there are no generators assigned to sustaining notes available for transfer, then generators will be transferred from old played solo notes in order to permit the sounding of newly played solo notes (step 636).

An analogous priority structure applies with respect to a change in the played notes of the accompaniment keyboard when the played notes of the solo keyboard remain constant (steps 620-628).

When new solo and accompaniment notes are played simultaneously (steps 612-616), if the system runs out of available generators (step 612) it will first transfer generators which had been assigned to sustaining solo and accompaniment notes on an oldest first priority (step 614). If this reassignment does not provide a sufficient number of generators, then generators will be transferred from previously played notes even though they are still being played (step 616), so that all newly played notes will be sounded.

These priorities can be implemented using a variety of note priority control methods. In one method, a set of storage registers referred to as a chromatic note priority stack is set up, with the number of registers in the stack corresponding to the number of tone generators in the system. The eight bits of the register would be allocated as follows:

| 7 | 6 | 5 | 4 | 3 | 2 | 1 | 0 |
|---|---|---|---|---|---|---|---|
| $A_{SG}$ | $A_A$ | $A_S$ | $A_{SUS}$ | H/L | $F_2$ | $F_1$ | $F_0$ |

Bits 0 through 2 of each note priority register designate the address of the chromatic note which is to be selected by the data selector; bit 3 of the chromatic note register designates whether the address given in bits 0 through 2 refers to the upper two-thirds of an octave (e.g., F through C) or the lower two-thirds of an octave (e.g., C# through G#); bit 4 identifies chromatic note registers assigned to notes which are being sustained; bit 5 of the chromatic note register identifies registers assigned to solo notes; bit 6 of the chromatic note register identifies registers assigned to accompaniment notes; and bit 7 of the chromatic note register identifies registers which are "current," to assist in the reassignment process.

In this method, whenever any change in the played notes is detected, bit 7 of each register in the chromatic note priority stack is set to 0. The chromatic notes are then assigned in order of priority: first, if the notes played on one manual have remained unchanged, the chromatic notes from that manual are assigned; next, the new notes are assigned; and finally, the previously played notes on the changing manual are assigned. As notes are assigned to each register, three counters are used to keep track of the assigned notes. The first counter (GU) is incremented each time a chromatic note is assigned in the upper one-third of an octave, or if the chromatic note corresponds to a sustaining note previously assigned to an upper range generator. Sustaining notes must be reassigned to the same generator they previously held since there is no way in the present embodiment of the subject invention to transfer information regarding the residual sustain level to a new generator. Similarly, a second counter (GL) is incremented whenever a chromatic note is assigned in the lower one-third octave, or if it corresponds to a sustaining note. A third counter (GT) is incremented each time any chromatic note is assigned. While the system of priorities will not permit the transfer of a generator from an unchanging manual, chromatic notes within the range of overlap between the high note range and the low note range can interchange generators in order to free a generator for assignment to a note outside the overlap range. As noted above, this cannot be done with respect to sustaining notes since the residual sustain level cannot be transferred to the new generator in the present embodiment of the subject invention.

Assignment of notes to be the chromatic note priority stack registers continues until the maximum number of notes have been assigned for the number of tone generators available. In particular, when the number in register GU equals the number of available upper generators, no more notes in the upper one-third octave can be assigned. When the number in register GL equals the number of available lower generators, no more notes in the lower one-third octave can be assigned. Finally, when the number in register GT equals the total number of available generators, no more notes can be assigned.

The assignment of "undedicated" chromatic notes (i.e. those in the middle one-third octave) can be carried out in a manner designed to optimize the compatibility of the notes in question with their assocated filters. The undedicated notes are assigned to the generator group preferred to filtering reasons, unless no such generators are available, in which case the note will be assigned to the alternate group. In either case the corresponding counter is incremented. The registers in the chromatic note priority stack are then reordered to place the played notes at the top of the stack and the sustaining notes at the bottom of the stack, without changing the order within each of these two groups establishing a sustain note age stack within the chromatic note priority stack. After each assignment process, the chromatic note priority stack is reordered with the newest notes at the top of the stack. In this manner, the oldest sustain notes will always be at the bottom of the stack, thereby facilitating reassignment of the oldest sustaining notes when necessary. In carrying out the foregoing steps, care must be taken to ensure that the same note is not assigned to two different generators (e.g., as a sustaining note and as a nonsustaining note), since this will obviously limit the availability of generators for other chromatic notes. As explained in detail above, if a generator is assigned to a particular chromatic note, it can sound that note in any octave, and therefore it is not necessary to have more than one generator assigned to the same chromatic note.

A second set of registers (referred to as the generator chromatic note storage registers) is set up with one register associated with each generator. This generator stack is set up in accordance with generator number, rather than time priority. The bit allocations for the generator chromatic note storage registers are as follows:

| 7 | 6 | 5 | 4 | 3 | 2 | 1 | 0 |
|---|---|---|---|---|---|---|---|
| $A_{SG}$ | — | — | — | Δ | $F_2$ | $F_1$ | $F_0$ |

Bits 0 through 2 designate the address of the chromatic note assigned to the generator corresponding to the particular register; bit 3 designates that the frequency assigned to the generator associated with that register is to be changed; and bit 7 indicates that the generator associated with that register is assigned (bits 4, 5, and 6 are not used for generator assignment). The notes assigned to the chromatic note priority stack are then transferred to the generator chromatic note storage registers. In this process, if a chromatic note to be assigned is already assigned to an existing generator, it will be assigned to that generator again. For those chromatic notes not previously assigned, the note storage register associated with the generator to be reassigned is marked (in bit 3) to identify it as a generator which is going to have its assigned frequency changed. All generators so marked have their keyers turned off and are damped (step 640) so that the sounding of the old note will be terminated before the new note is initated. The keyers corresponding to assigned generators (marked in bit 7) which have to be triggered in order to produce the desired note and octave are then outputted and the new frequency assignments are outputted to the generators. The program delay while this step is carried out allows time for the keyers to be damped at the old frequency before they are retriggered at the new frequency. It should be noted that when the system is operating in a percussive mode, only added notes need to be computed. Approximately ten milliseconds after the added notes are outputted, their keyers are turned off and permitted to sustain.

Figures 7, 9:
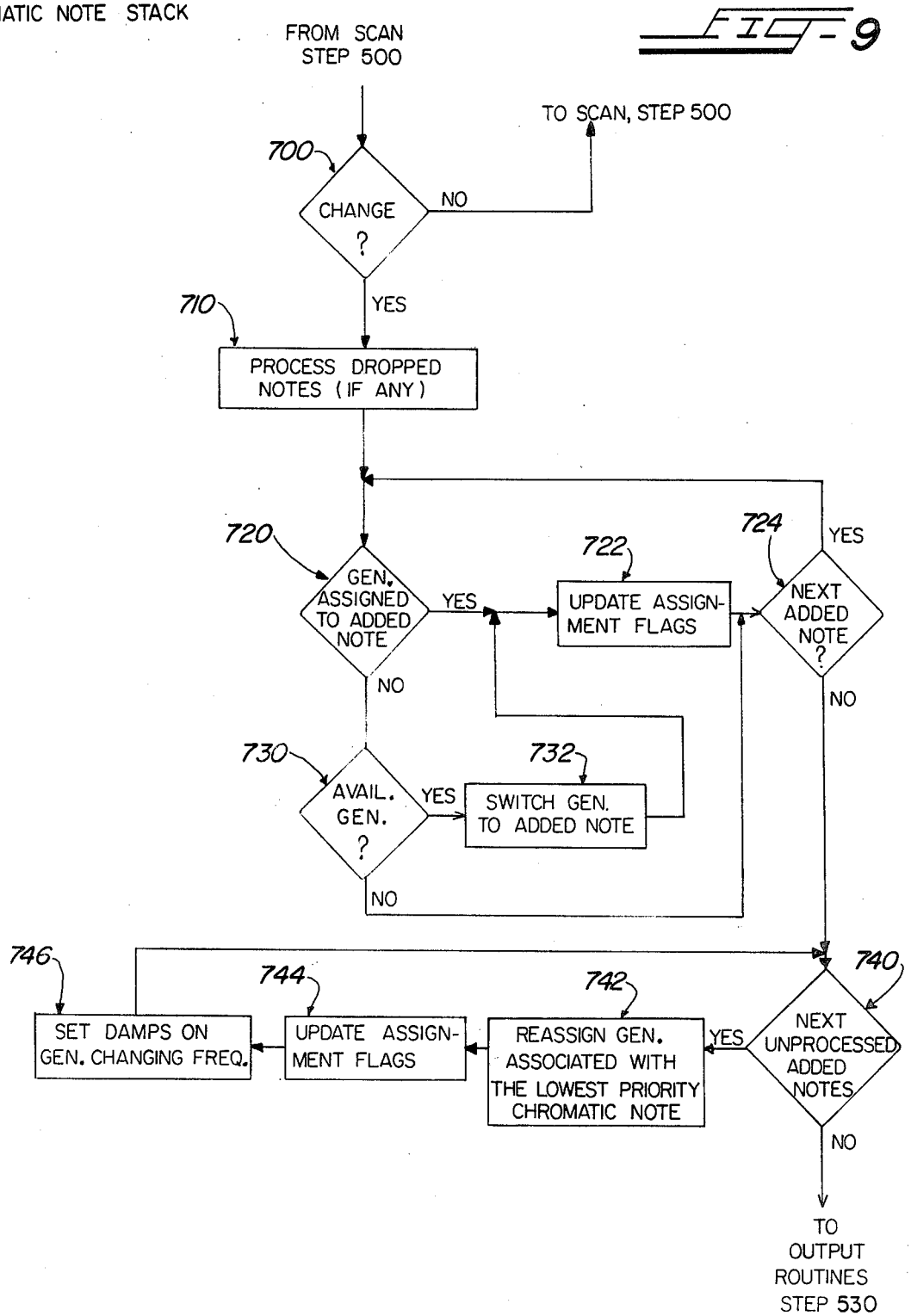
FIG. 9 is a flow chart depicting an alternative priority sequence for assigning generators.

An alternative means of implementing the generator priorities described above is Priority Sequence II (Chromatic Note Stack), depicted in flow chart form in FIG. 9, which utilizes a set of twelve registers referred to as the chromatic note stack, one of which is assigned to each of the twelve chromatic notes. The bit assignments for the chromatic note registers is as follows:

| 7 | 6 | 5 | 4 | 3 | 2 | 1 | 0 |
|---|---|---|---|---|---|---|---|
| $A_{SG}$ | $A_A$ | $A_S$ | $A_{SUS}$ | $G_3$ | $G_2$ | $G_1$ | $G_0$ |

Bits 0 through 3 designate the number of the generator assigned to a particular note (with "1111" indicating that no generator is assigned to that note); bit 4 indicates whether the associated note is to be sustained; bit 5 indicates whether the associated note is played on the solo manual; bit 6 indicates whether the associated note is played on the accompaniment manual; and bit 7 is used to indicate the current status of the information in the register. When the system is initialized, each of the generators in the system is loaded into one of the chromatic note registers, and the remaining registers are loaded with ones.

An additional set of registers, one for each pair of generators, referred to as the generator stack, is set up, with each half of each register assigned to a particular generator. The bit assignments for the generator stack are as follows:

| 7 | 6 | 5 | 4 | 3 | 2 | 1 | 0 |
|---|---|---|---|---|---|---|---|
| Δ | $F_2$ | $F_1$ | $F_0$ | Δ | $F_2$ | $F_1$ | $F_0$ |

Bits 0 through 2 of each register of the generator stack designate the address of the chromatic note corresponding to its associated generator; bit 3 indicates that the frequency assigned to a generator associated with the particular register has not yet been processed. Bits 4 through 7 serve the identical purpose with respect to a different generator.

A third set of registers referred to as the chromatic note priority stack is set up for controlling sustain priority, with approximately the same number of registers as there are generators. The bit utilization for the registers of the chromatic note priority stack is as follows:

-continued

| 7 | 6 | 5 | 4 | 3 | 2 | 1 | 0 |
|---|---|---|---|---|---|---|---|
| DBL | A | S | — | $FA_3$ | $FA_2$ | $FA_1$ | $FA_0$ |

Bits 0 through 3 identify the chromatic note stored in the particular register; bit 5 indicates whether the note in question is being sounded on the solo manual; bit 6 indicates whether the note in question is being sounded on the accompaniment manual; and bit 7 indicates whether the note in question has more than one priority assigned (bit 4 is not used).

When any note associated with a particular generator becomes a sustaining note (either because it is played percussively or because the key associated with the note is released in the sustain mode) that chromatic note is loaded into highest priority register of the chromatic note priority stack, and the priority of the data already in place in the chromatic note priority stack is reduced. If the chromatic note in question was already in the stack from the same manual, its previous position is deleted and only the intervening registers are reduced in priority. If the chromatic note in question was already in the chromatic note priority stack for a note on the other manual, the new and old locations are identified by a 1 placed in bit 7 of both registers. This use of bit 7 prevents the generator assignment routine from identifying a low priority note on one manual and transferring its associated generator to another frequency when it is also a high priority note on the other manual.

If the chromatic note priority stack overflows because one chromatic note is holding two registers, the sustain bit in the chromatic note stack for the low priority note is set to 0, thereby making it available for reassignment.

The first step in generator assignment in this alternative method is to process dropped notes (step 710 in FIG. 9). When the last key corresponding to a chromatic note has been released, bits 5 and 6 of the associated storage register in the chromatic note stack will be set to 0. Bit 7 is then set to 0 on all of the registers on the chromatic note stack. Because each chromatic note has a permanent storage location in this alternate method, the chromatic note generator allocation for previously played keys can be retained. Therefore, only added notes need to be assigned, and as a result this method is faster than the first method described above. In many cases, it will only be necessary to check a chromatic note to determine whether a generator is already assigned to it (steps 720–724). If this is found to be the case, bit 7 of the associated register in the chromatic note stack is set to 1, and the added note in question has been provided for (step 722). If this is not the case, then the registers in the chromatic note stack are searched to determine whether a generator is available (steps 730 and 732). For notes in the dedicated range (i.e., the top one-third or bottom one-third octave), notes which are not dedicated to either the upper or lower programmable generators are searched first. If the note to be provided is undedicated, then the notes in the dedicated range are searched first. In this manner, the undedicated notes can be assigned in their preferred group if possible. In order to maintain optimum generator utilization, assignment of dedicated notes is carried out before the assignement of undedicated notes. If generators have not been provided for all notes which require generators after these steps have been completed, the remaining notes (step 740) are assigned to the lowest priority generators (steps 742–746) in accordance with the foregoing criteria. To further enhance the utilization of generators, if the generator associated with an undedicated old played note is transferred to an added note, a search is made for an available generator in the other group so as to maintain maximum generator utilization.

When a generator is reassigned to a new frequency during the assignment process, this new frequency is loaded into the generator stack, and the associated change bit is set. The setting of the change bit enables the associated keyers to be damped so that the sounding of the old notes will be discontinued before the new note begins to sound.

It will be apparent to one skilled in the art that the first method discussed above requires less storage than the second method. However, because the first method requires all assignments to be reprocessed when any change occurs, the first method is slower than the second method. Particularly in an organ system having partial stop tabs, the second method of generator assignment has been found to be preferable. The reason for this is that more than one generator may have to be assigned for keys placed in a partial stop. It has also been found to be advantageous to include one extra generator in each group (upper $\frac{2}{3}$ octave and lower $\frac{2}{3}$ octave) which can only be assigned to partials. In this manner, gate costs can be reduced. An additional reduction in computation time can be achieved by having a first microprocessor compute added keys for existing generators while a second microprocessor* confirms generator assignments, and transfers any additional generators which are required. If no transfers are required, keyer information can be outputed immediately.

*See co-pending application "Electronic Musical Instrument Having Internal Fault Detection Feature," Ser. No. 163,320 filed June 26, 1980.

While certain preferred embodiments of the present invention have been illustrated and described, a number of modifications and variations to the present invention are contemplated. In particular, it should be clear that the present invention is not limited to microprocessor controlled organ systems, but rather is applicable to any organ system wherein programmable signal generators are used. Further, it can readily be seen that the present invention can function regardless of the word size of the digital logic device which is used. Accordingly, the present invention is not limited to the precise construction disclosed herein, and therefore the present invention encompasses all variations within the scope of the appended claims.

We claim:

1. An improved electronic musical instrument having a keyboard, function controls, voice controls, and an audio output system comprising:

a plurality of switches associated with the keys of the keyboard, the function controls and the voice controls;

address means for generating multiple bit binary data identifying which of the switches are closed;

control means for processing the data generated by the address means and determining from the data the notes to be sounded;

a top octave generator for producing top octave generator signals; and a plurality of programmable generators each capable of generating any one of a plurality of pitch frequencies of different chromatic nomenclatures numbering fewer than twelve and being progammable by the control means for converting a top octave generator signal specified by said control means to at least one octave specified by said control means in accordance with the data generated by the address means, each programmable generator being capable, in conjunction with said control means, of passing signals for the same chromatic note in more than one octave to the audio output system simultaneously.

2. An improved electronic musical instrument as claimed in claim 1 wherein each of the programmable generators is capable of selecting one signal from among eight of the twelve signals generated by the top octave generator.

3. An improved electronic musical instrument as claimed in claim 1 or 2 wherein the number of programmable generators is seven.

4. An improved electronic musical instrument including a keyboard and an audio output system comprising:

digital logic control means responsive to the played keys of the keyboard for determining the notes to be sounded;

a top octave generator for producing signals corresponding to the twelve notes of a musical octave, said signals having a frequency at least as high as the highest octave in which the note corresponding to that signal can be played on the keyboard of the instrument;

a plurality of data selectors numbering fewer than twelve, each receiving as an input a plurality of said signals, each being responsive to the digital logic control means for selecting a single signal from among said input signals that is related to at least one of the played keys in a manner determined by the digital logic control means;

a plurality of dividers each divider responsive to an associated data selector for producing signals octavely related to, and lower than, the signals selected by their associated data selectors, and a plurality of gates responsive to the digital logic control means and electrically connected to the dividers for passing signals in more than one octave from the dividers and the data selectors simultaneously to the audio output system.

5. An improved electronic musical instrument as claimed in claim 4 further comprising sustain means responsive to the control means and electrically connected to the gates for controlling the rates at which the signals passed by the gates decay.

6. An improved electronic instrument as claimed in claim 4 or claim 5 wherein the number of data selectors is seven, and each data selector can select one of eight notes from the top octave generator.

7. An improved electronic musical instrument including one or more keyboards and an audio output system comprising:

system control means responsive to the played keys of the keyboards;

a plurality of programmable generators responsive to the system control means for producing tone signals corresponding to keys of the keyboards;

a plurality of gates connected to the generators and responsive to the system control means for passing selected tone signals to the audio output system; and note priority control means for controlling the chromatic note assignment of each of the programmable generators by the system control means and controlling the programmable generators such that each such generator can generate tone signals in more than one octave simultaneously, said note priority control means adapted to reassign a programmable generator producing a first tone signal to a new tone signal corresponding to a newly played key if no unused generators are available.

8. An improved electronic musical instrument as claimed in claim 7 further comprising sustain means responsive to the system control means and connected to the gates for controlling the rate of decay of the tone signals passed by the gates.

9. An improved electronic musical instrument as claimed in claim 8 wherein the note priority control means further comprises a sustain note age stack for identifying the sustain notes in age order.

10. An improved electronic musical instrument as claimed in claim 9 wherein a newly played note on a keyboard will be assigned by the note priority control means to the generator associated with the oldest sustain note in the sustain note age stack associated with the same keyboard as the newly played note.

11. An improved electronic musical instrument as claimed in claim 10 wherein if there are no sustain notes in the sustain note age stack associated with the same keyboard as the newly played note, the note priority control means will assign the newly played note to the generator assigned to the oldest sustain note in the sustain note age stack associated with another keyboard except that the M newest notes (where M is at least one) in such sustain note age stack will not be reassigned to a newly played note on another keyboard.

12. An improved electronic musical instrument including two or more keyboards and an audio output system, comprising:

system control means responsive to the played keys of the keyboards;

a plurality of programmable generators responsive to the system control means for producing tone signals corresponding to keys of the keyboards;

a plurality of gates connected to the generators and responsive to the system control means for passing selected tone signals to the audio output system, note priority control means for controlling the chromatic note assignment of each of the programmable generators by the system control means and controlling the programmable generators such that each such generator can generate tone signals in more than one octave simultaneously, said note priority control means adapted to reassign a programmable generator producing a first tone signal to a new tone signal corresponding to a newly played key if no unused generators are available, unless said first tone signal is associated with a key on a keyboard different from the keyboard for the newly played key.

* * * * *